US010819011B2

(12) United States Patent
Lee et al.

(10) Patent No.: US 10,819,011 B2
(45) Date of Patent: Oct. 27, 2020

(54) ELECTRONIC DEVICE COMPRISING AN ANTENNA

(71) Applicant: Samsung Electronics Co., Ltd., Gyeonggi-do (KR)

(72) Inventors: Han Bin Lee, Gyeonggi-do (KR); Jae Hyung Kim, Gyeonggi-do (KR); Hua Li, Gyeonggi-do (KR); Je Sun Moon, Gyeonggi-do (KR); Jin Kyu Bang, Gyeonggi-do (KR); Chang Ha Yu, Gyeonggi-do (KR); Sung Yeul Hong, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 182 days.

(21) Appl. No.: 15/991,504

(22) Filed: May 29, 2018

(65) Prior Publication Data

US 2018/0342793 A1 Nov. 29, 2018

(30) Foreign Application Priority Data

May 29, 2017 (KR) ..... 10-2017-0066463

(51) Int. Cl.
*H01Q 1/24* (2006.01)
*H01Q 1/38* (2006.01)
(Continued)

(52) U.S. Cl.
CPC ..... *H01Q 1/243* (2013.01); *H01Q 1/2291* (2013.01); *H01Q 1/38* (2013.01); *H01Q 5/335* (2015.01); *H01Q 13/106* (2013.01); *H01Q 21/28* (2013.01)

(58) Field of Classification Search
CPC .... H01Q 1/243; H01Q 1/2291; H01Q 13/106; H01Q 9/0421
See application file for complete search history.

(56) References Cited

U.S. PATENT DOCUMENTS 7,848,771 B2 12/2010 Boyle
9,716,307 B2 7/2017 Tsai et al.
(Continued)

FOREIGN PATENT DOCUMENTS

CN 1788390 6/2006
CN 103811863 5/2014
(Continued)

OTHER PUBLICATIONS

International Search Report dated Aug. 31, 2018 issued in counterpart application No. PCT/KR2018/006075, 13 pages.
(Continued)

*Primary Examiner* — Hoang V Nguyen
(74) *Attorney, Agent, or Firm* — The Farrell Law Firm, P.C.

(57) ABSTRACT

An electronic device is provided. The electronic device includes a housing including a first plate, a second plate facing the first plate, and a side member surrounding a space between the first plate and the second plate and a circuit board, which is accommodated inside a housing and in which a wireless communication circuit is disposed. The second plate includes a slot filled with a non-conductive material. An area other than the slot is formed of a conductive material. The circuit board includes a conductive pattern formed on the circuit board along with the slot of the second plate, and the wireless communication circuit is configured to feed one point of the second plate adjacent to the slot to receive a signal of a first frequency band through an electrical path formed by the slot and to feed the conductive pattern to receive a signal of a second frequency band through the slot.

19 Claims, 12 Drawing Sheets

(51) Int. Cl.

| | |
|---|---|
| ***H01Q 1/22*** | (2006.01) |
| ***H01Q 13/10*** | (2006.01) |
| ***H01Q 5/335*** | (2015.01) |
| ***H01Q 21/28*** | (2006.01) |

(56) References Cited

U.S. PATENT DOCUMENTS

| | | | | |
|---|---|---|---|---|
| 10,038,245 | B2 | 7/2018 | Choi et al. | |
| 10,164,439 | B2 | 12/2018 | Jeong | |
| 10,218,052 | B2 | 2/2019 | Pascolini et al. | |
| 10,490,883 | B2 | 11/2019 | Tsai et al. | |
| 2007/0040751 | A1 | 2/2007 | Boyle | |
| 2014/0125528 | A1 | 5/2014 | Tsai et al. | |
| 2015/0070219 | A1 | 3/2015 | Dinh et al. | |
| 2015/0125528 | A1 | 5/2015 | Langdo et al. | |
| 2016/0197403 | A1 | 7/2016 | Choi et al. | |
| 2016/0336643 | A1* | 11/2016 | Pascolini | H01Q 9/0442 |
| 2016/0344090 | A1 | 11/2016 | Chiang et al. | |
| 2017/0047641 | A1 | 2/2017 | Kim et al. | |
| 2017/0110787 | A1* | 4/2017 | Ouyang | H01Q 1/243 |
| 2017/0117616 | A1 | 4/2017 | Chen et al. | |
| 2017/0256845 | A1 | 9/2017 | Tsai et al. | |
| 2017/0256846 | A1 | 9/2017 | Tsai et al. | |
| 2018/0090819 | A1 | 3/2018 | Wang et al. | |
| 2019/0165453 | A1 | 5/2019 | Tsai et al. | |
| 2019/0214708 | A1 | 7/2019 | Ouyang et al. | |
| 2019/0386381 | A1 | 12/2019 | Tsai et al. | |

FOREIGN PATENT DOCUMENTS

| | | |
|---|---|---|
| CN | 105763206 | 7/2016 |
| CN | 205543197 | 8/2016 |
| CN | 106605333 | 4/2017 |
| CN | 206076482 | 4/2017 |
| EP | 3 041 083 | 7/2016 |
| JP | 2003-318622 | 11/2003 |
| KR | 10-1571289 | 11/2015 |
| WO | WO 2004/102744 | 11/2004 |
| WO | WO 2016/155591 | 10/2016 |

OTHER PUBLICATIONS

European Search Report dated Apr. 24, 2020 issued in counterpart application No. 18810526.6-1205, 9 pages.

Chinese Office Action dated Sep. 8, 2020 issued in counterpart application No. 201880034656.1, 27 pages.

* cited by examiner (1)

(2)

ELECTRONIC DEVICE COMPRISING AN ANTENNA

CROSS-REFERENCE TO RELATED APPLICATION(S)

This application is based on and claims priority under 35 U.S.C. § 119(a) to Korean Patent Application Serial No. 10-2017-0066463, filed on May 29, 2017, in the Korean Intellectual Property Office, the entire disclosure of which is incorporated herein by reference.

BACKGROUND

1. Field

The present disclosure relates, generally, to an electronic device, and more particularly, to an electronic device including an antenna that uses a metal housing of the electronic device.

2. Description of Related Art

An antenna provided in the electronic device, e.g., a smartphone, a tablet, or the like, may be formed of a conductive material, and may be used to communicate with a network.

While a housing, which is typically made of metal, has been used to improve the rigidity and design of the electronic device, the antenna performance in the electronic device may be deteriorated due to a scattering effect by the metal, confinement effect of an electromagnetic field, mismatch, or the like.

SUMMARY

The disclosure has been made to address at least the disadvantages described above and to provide at least the advantages described below. Accordingly, an aspect of the disclosure provides an electronic device that uses a slot, which is formed in a housing, as a radiation area of an antenna disposed inside the housing.

According to an aspect of the disclosure, an electronic device may include a plurality of antennas that are mounted in a slot formed in a metal housing.

According to an aspect of the disclosure, the slot can be formed on a rear surface of the metal housing and may be an element or part of the antenna, or may be a radiation area for another antenna inside of the electronic device.

In accordance with an aspect of the disclosure, there is provided an electronic device. The electronic device includes a conductive pattern, a wireless communication circuit electrically connected to the conductive pattern, and a conductive layer and a non-conductive slot formed through the conductive layer, wherein the non-conductive slot and the side member form a closed loop, and wherein the conductive pattern includes an elongated portion that at least partially overlaps the non-conductive slot.

In accordance with an aspect of the disclosure, there is provided an electronic device. The electronic device includes a housing and a circuit board including a wireless communication circuit, wherein the circuit board includes a conductive pattern and a slot, and wherein the wireless communication circuit is configured to: feed one point adjacent to the slot to receive a signal of a first frequency band through an electrical path formed by the slot; and feed the conductive pattern to receive a signal of a second frequency band through the slot.

In accordance with an aspect of the disclosure, there is provided an electronic device. The electronic device includes a housing including a first plate, a second plate facing the first plate, and a side member surrounding a space between the first plate and the second plate and a circuit board including a wireless communication circuit, wherein the second plate includes a first slot and a second slot, which are filled with a non-conductive material and includes a conductive material interposed between one end of the first slot and one end of the second slot, wherein an area other than the first slot and second slot of the second plate is formed of a conductive material, wherein the circuit board includes a first conductive pattern formed on the circuit board along with the second slot of the second plate, and wherein the wireless communication circuit is configured to: feed one point of the second plate adjacent to the first slot to receive a signal of a first frequency band through an electrical path formed by the first slot of the second plate; feed another point of the second plate adjacent to the second slot to receive a signal of a second frequency band through an electrical path formed by a second slot of the second plate; and feed the first conductive pattern to receive a signal of a third frequency band through the second slot.

BRIEF DESCRIPTION OF THE DRAWINGS

The above and other aspects, features and advantages of certain embodiments of the disclosure will be more apparent from the following detailed description taken in conjunction with the accompanying drawings, in which.

DETAILED DESCRIPTION

Figure 1A:
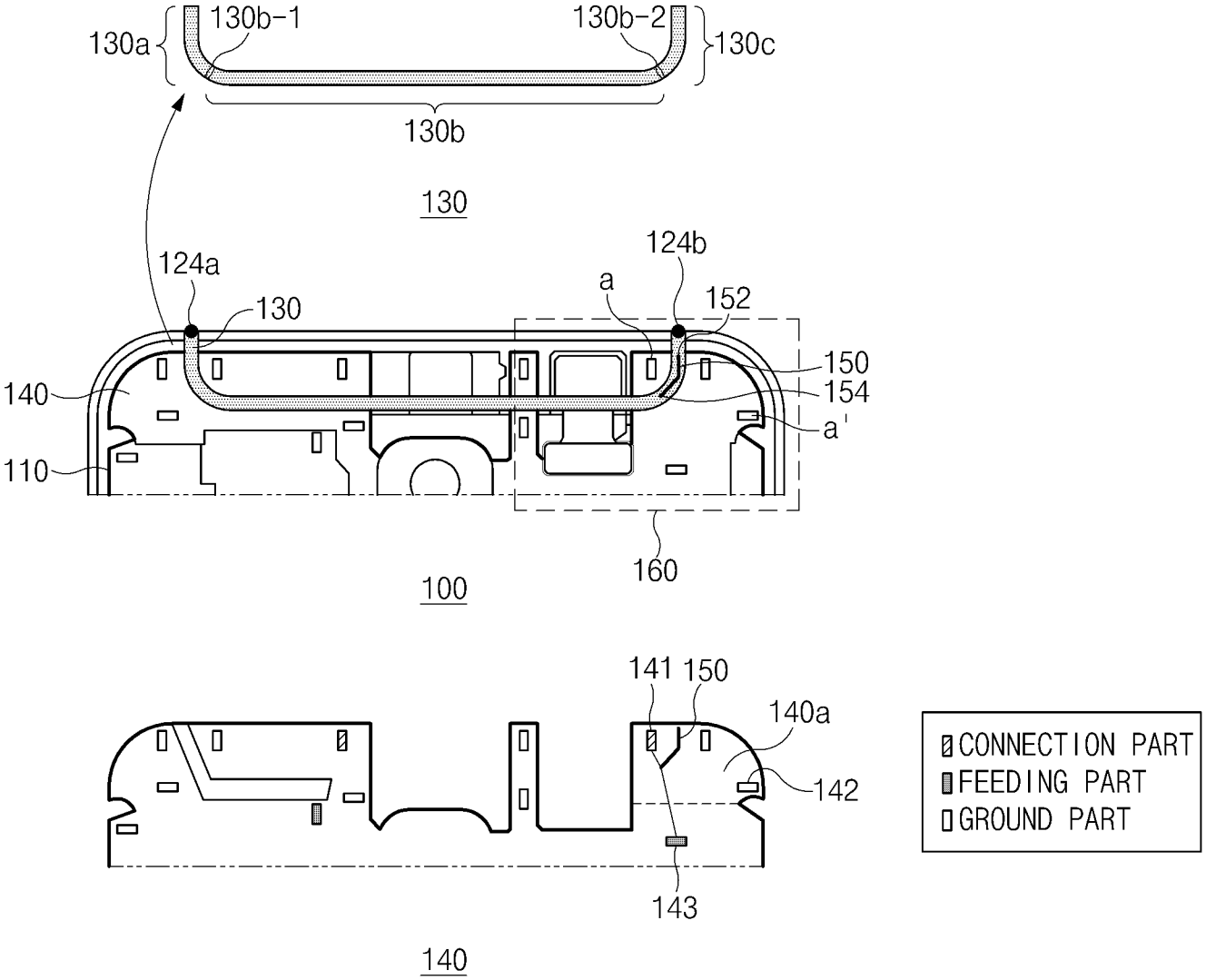
FIG. 1A is a diagram of a portion of an electronic device, according to an embodiment.

Embodiments of the disclosure will be described herein below with reference to the accompanying drawings. However, the embodiments of the disclosure are not limited to the specific embodiments and should be construed as including all modifications, changes, equivalent devices and methods, and/or alternative embodiments of the present disclosure. In the description of the drawings, similar reference numerals are used for similar elements.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may use corresponding components regardless of importance or an order and are used to distinguish a component from another without limiting the components. These terms may be used for the purpose of distinguishing one element from another element. For example, a first user device and a second user device may indicate different user devices regardless of the order or importance. For example, a first element may be referred to as a second element without departing from the scope the disclosure, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be used interchangeably with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a central processing unit (CPU) or an application processor (AP)) capable of performing a corresponding operation by executing one or more software programs stored in a memory device.

The terms used in describing the various embodiments of the disclosure are for the purpose of describing particular embodiments and are not intended to limit the disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the disclosure.

The terms used in describing the various embodiments of the disclosure are for the purpose of describing particular embodiments and are not intended to limit the disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the disclosure.

An electronic device according to the disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a MPEG-1 audio layer-3 (MP3) player, a mobile medical device, a camera, and a wearable device. The wearable device may include at least one of an accessory type (e.g., a watch, a ring, a bracelet, an anklet, a necklace, a glasses, a contact lens, or a head-mounted device (HMD)), a fabric or clothing integrated type (e.g., an electronic clothing), a body-mounted type (e.g., a skin pad, or tattoo), and a bio-implantable type (e.g., an implantable circuit).

The electronic device may be a home appliance. The home appliance may include at least one of, for example, a television, a digital video disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

The electronic device may include at least one of various medical devices (e.g., various portable medical measuring devices (a blood glucose monitoring device, a heart rate monitoring device, a blood pressure measuring device, a body temperature measuring device, etc.), a magnetic resonance angiography (MRA), a magnetic resonance imaging (MRI), a computed tomography (CT) machine, and an ultrasonic machine), a navigation device, a global positioning system (GPS) receiver, an event data recorder (EDR), a flight data recorder (FDR), a vehicle infotainment device, an electronic device for a ship (e.g., a navigation device for a ship, and a gyro-compass), avionics, security devices, an automotive head unit, a robot for home or industry, an automatic teller machine (ATM) in banks, point of sales (POS) devices in a shop, or an Internet of things device (IoT) (e.g., a light bulb, various sensors, electric or gas meter, a sprinkler device, a fire alarm, a thermostat, a streetlamp, a toaster, a sporting goods, a hot water tank, a heater, a boiler, etc.).

The electronic device may include at least one of a part of furniture or a building/structure, an electronic board, an electronic signature receiving device, a projector, and various kinds of measuring instruments (e.g., a water meter, an electric meter, a gas meter, and a radio wave meter). The electronic device may be a combination of one or more of the aforementioned various devices. The electronic device may also be a flexible device. Further, the electronic device is not limited to the aforementioned devices, and may include an electronic device according to the development of new technology.

Hereinafter, an electronic device will be described with reference to the accompanying drawings. In the disclosure, the term "user" may indicate a person using an electronic device or a device (e.g., an artificial intelligence electronic device) using an electronic device.

Figure 1B:
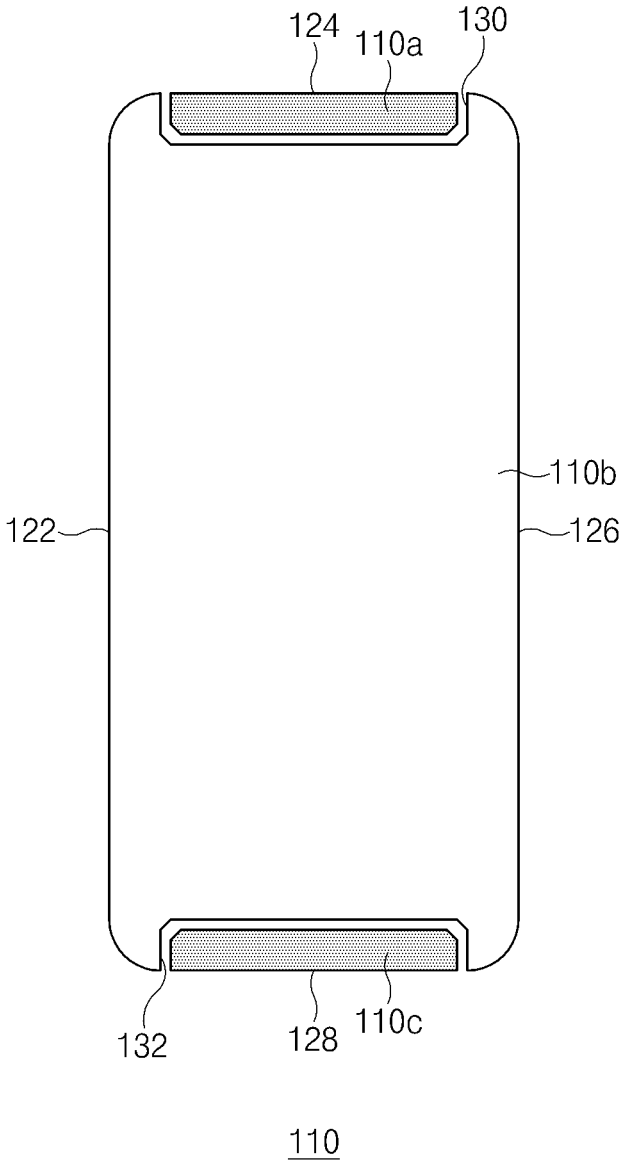
FIG. 1B is a diagram of a second plate of an electronic device, according to an embodiment.
Figure 1C:
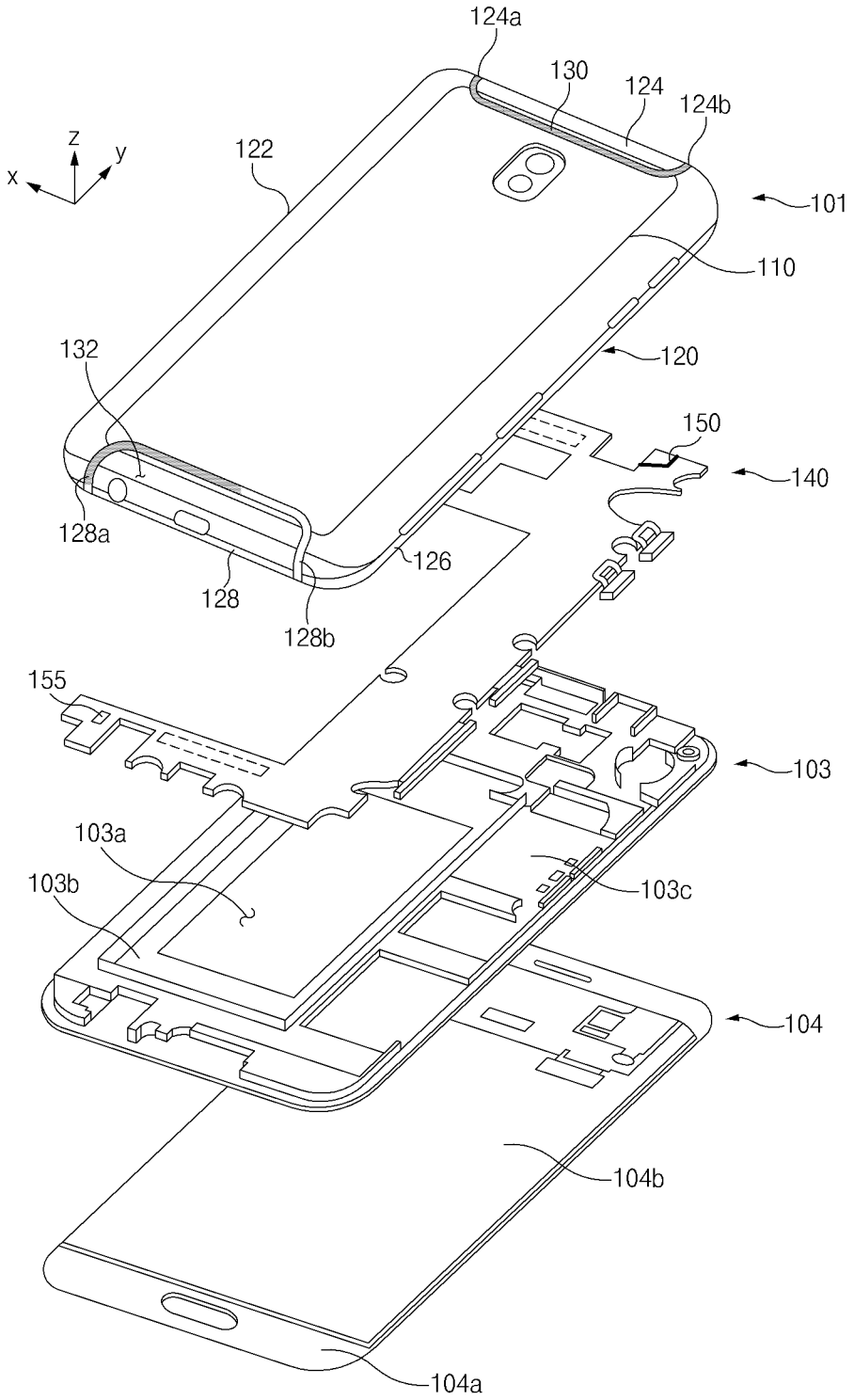
FIG. 1C is an exploded, perspective view of an electronic device, according to an embodiment.

FIG. 1A is a diagram of an electronic device, according to an embodiment. FIG. 1B is a diagram of a second plate, according to an embodiment. FIG. 1C is an exploded, perspective view of an electronic device, according to an embodiment.

Referring to FIGS. 1A to 1C, an electronic device 100 according to an embodiment may include a housing that includes a first plate, a second plate 110 facing the first plate, a side member 120 (FIG. 1C) surrounding a space between the first plate and the second plate 110.

The second plate 110 may include a non-conductive slot 130 (FIGS. 1B and 1C) filled with a non-conductive material. An area other than the non-conductive slot 130 of the second plate 110 may be formed of a conductive material. A first conductive layer 110*a* of the second plate 110 and a second conductive layer 110*b* of the second plate 110 may be electrically separated by the non-conductive slot 130.

The electronic device 100 may include a circuit board 140 which is provided inside a housing and in which a wireless communication circuit 131 (as will be described below with reference to FIG. 2) is disposed. Referring to FIG. 1A, the circuit board 140 disposed inside the second plate 110 is separately illustrated under the second plate 110. The circuit board 140 may be disposed inside the second plate 110.

The circuit board 140 of the electronic device 100 may include a conductive pattern 150 formed along the non-conductive slot 130 of the second plate 110 and formed on the circuit board 140. For example, the conductive pattern 150 may be positioned in the area of the circuit board 140 facing the non-conductive slot 130. The conductive pattern 150 may be formed to be the same or similar to a portion of the non-conductive slot 130.

The wireless communication circuit 131 of the electronic device 100 may feed a point 'a' of the second plate 110 adjacent to the non-conductive slot 130. The wireless communication circuit 131 may receive a signal of the first frequency band via an electrical path formed by the non-conductive slot 130.

For example, when the 'a' point is fed, one portion of the first conductive layer 110*a*, one portion of the second conductive layer 110*b*, and one portion of the non-conductive slot 130 may operate as a first antenna 160.

The wireless communication circuit 131 of the electronic device 100 may be configured to feed the conductive pattern 150, and may receive a signal in the second frequency band through the non-conductive slot 130.

For example, the conductive pattern 150 may operate as a second antenna different from the first antenna 160, which has the first conductive layer 110*a* as an antenna radiator.

Since the second plate 110 is formed of a conductive material, a radiation space for the conductive pattern 150 positioned inside the electronic device 100 is required. The conductive pattern 150 may be disposed to face the non-conductive slot 130. Thus, the conductive pattern 150 may receive an external signal through at least a portion of the non-conductive material filled in the non-conductive slot 130 and may transmit the signal to the outside.

The circuit board 140 may include a connection part connected to the second plate 110 and a feeding part, and the circuit board 140 may include a ground part that connects a ground layer of the circuit board 140 to the second plate 110.

The circuit board 140 may include a non-conductive area 140*a* (e.g., a fill-cut area), and may include the conductive pattern 150 formed in the non-conductive area 140*a*.

The circuit board 140 may include a feeding part 143 (FIG. 1A) for feeding the 'a' point and the conductive pattern 150. The feeding part 143 may be electrically connected to a processor of the circuit board 140. The circuit board 140 may include two feeding parts 143 for feeding the 'a' point and the conductive pattern 150, respectively.

The circuit board 140 may include a connection member 141 for directly/indirectly feeding the 'a' point being the feeding point of the second plate 110. The connection member 141 may include a C-clip, a screw, and a conductive member, or other suitable device. The circuit board 140 may further include a feeding line connected from the feeding part 143 to the connection member 141.

The circuit board 140 may include a ground layer connected to a ground point (e.g., the a' point) of the second plate 110.

The non-conductive slot 130 may have various shapes, and the conductive pattern 150 can be positioned inside the housing and may have a shape corresponding to the non-conductive slot 130. For example, the non-conductive slot 130 may have a U-shape, or other suitable shape. The conductive pattern 150 may be formed in a pattern similar to the partial area of the non-conductive slot 130.

The non-conductive slot 130 may be formed in the area of the second plate 110 corresponding to the location of the conductive pattern in the housing. For example, the non-conductive slot 130 may have a U-shape that contacts the edge of the second plate 110. The non-conductive slot 130 may be used as the radiation area of the second antenna therein.

The side member 120 of the electronic device 100 may include at least a portion of the non-conductive slot 130. For example, the non-conductive slot 130 may be formed in the partial area of the side member 120 and the second plate 110.

The remaining area of the side member 120, other than one portion of the non-conductive slot 130 formed in the side member 120, may be formed of a conductive material. The electronic device 100 may include a five-sided metal housing in which the second plate 110 and the side member 120 are integrally formed. Alternatively, the electronic device 100 may include a five-sided metal housing with the side member 120 attached or coupled to the second plate 110.

The side member 120 of the electronic device 100 may include a first side 122, a second side 124, a third side 126, and a fourth side 128. The first side 122 may extend in a first direction and may have a first length. The second side 124 may extend in a second direction perpendicular to the first direction and may have a second length shorter than the first length. The third side 126 may extend in parallel to the first side 122 and may have the first length. The fourth side 128 may extend in parallel to the second side 124 and may have the second length. The side member 120 may be formed in a rectangular shape.

The non-conductive slot 130 may extend from a first point 124*a* of the second side 124 to a second point 124*b* of the second side 124 along the second plate 110. The second plate 110 may include different conductive areas separated by the non-conductive slot 130. The non-conductive slot 130 may be formed in a U-shape from the first point 124*a* of the second side 124 to the second point 124*b* along the second plate 110.

The circuit board 140 of the electronic device 100 may be disposed inside the housing such that the conductive pattern 150 extends from a first point 152 of the non-conductive slot 130 to a second point 154 of the non-conductive slot 130 along the non-conductive slot 130, while facing the non-conductive slot 130.

The conductive pattern 150 may be a pattern of a metal material formed on the circuit board 140 to transmit and receive signals of a specific frequency band. The conductive pattern 150 may have different patterns depending on the target frequency, and the pattern of the conductive pattern 150 may be formed to correspond to the shape of all or part of the area of the non-conductive slot 130.

The second plate 110 of the electronic device 100 may further include the non-conductive slot 130 and another slot 132. The second conductive layer 110*b* of the second plate 110 and the third conductive layer 110*c* of the second plate 100 may be electrically separated by the other slot 132. One portion of the second conductive layer 110*b*, one portion of the third conductive layer 110*c*, and one portion of the other slot 132 may operate as a third antenna.

The circuit board 140 of the electronic device 100 may include another conductive pattern formed thereon along the other slot 132. The other conductive pattern may operate as an antenna, which uses the third conductive layer 110*c* as an antenna radiator and which is different from the third antenna.

The side member 120 of the electronic device 100 may be attached to the second plate 110 or may be integrally formed with the second plate 110.

The second plate 110 of the electronic device 100 may include the conductive layer 110*b* and the non-conductive slot 130 formed by passing through the conductive layer 110*b*. The non-conductive slot 130 may be referred to as a "non-conductive strip". The non-conductive slot 130 may extend from the first portion 124*a* of the second side 124 of the side member 120 to the second portion 124*b* of the second side surface 124 of the side member 120 such that the non-conductive slot 130 and the side member 120 together may form a closed loop when viewed from above the second plate 110.

The electronic device 100 may include a touchscreen display exposed through a portion of the first plate.

The conductive pattern 150 may be positioned between the first plate and the second plate 110.

The conductive pattern 150 may include an elongated portion that overlaps at least partly with the non-conductive slot 130 when viewed from above the second plate 110. While FIG. 1A illustrates all portions of the conductive pattern 150 being overlapped with the non-conductive slot 130, the disclosure is not so limited. For example, only a single one portion of the conductive pattern 150 may overlap with the non-conductive slot 130.

The wireless communication circuit 131 on the circuit board 140 may be disposed in the space between the first plate and the second plate 110 and electrically connected to the conductive pattern 150. The wireless communication circuit 131 may be configured to support Wi-Fi communication in a frequency that ranges from about 2.4 GHz to 5 GHz, or greater than 5 GHz and less than 2.4 GHz.

The wireless communication circuit 131 may be configured to provide a signal having a 5 GHz frequency to one portion of the conductive pattern 150, and the conductive pattern 150 may operate as an antenna radiator for an antenna that transmits and receives 5 GHz frequency.

The non-conductive slot 130 may include a first portion 130*a* extending in a first direction, a second portion 130*b* extending in a second direction substantially perpendicular to the first direction, and a third portion 130*c* extending in the first direction. A first end 130*b*-1 of the second portion 130*b* may be connected to the first portion 130*a*, and a second end 130*b*-2 of the second portion 130*b* may be connected to the third portion 130*c*. The first direction may be a direction oriented parallel to the first side 122 of the side member 120. The second direction may be a direction oriented parallel to the second side 124 of the side member 120.

The non-conductive slot 130 may form a U-shape when viewed from above the second plate 110. At least a portion with which the non-conductive slot 130 of the conductive pattern 150 overlaps may overlap with the first or third portion of the non-conductive slot 130.

The partial area of the second portion of the non-conductive slot 130 may include a conductive material extending from the second plate 110. The non-conductive slot 130 may include a first area and a second area that are separated by the partial area. For example, the first area and the second area may operate as radiators for different antennas.

Referring to FIG. 1C, the electronic device 100 may include a housing 101 generally formed of a metal material and a display 104, which is coupled to the circuit board 140, a support member 103, and the housing 101, which are disposed in the inner space of the housing 101 and which is implemented with a part of the appearance of the electronic device 100. Although not illustrated, the electronic device 100 may include a battery for an internal power supply and a wireless charging member for charging the battery that are disposed therein.

The housing 101 may include a first plate, the second plate 110 disposed at a location opposite to the first plate, and the side member 120 disposed in the manner to surround a space between the first plate and the second plate 110. The first plate, the second plate 110, and the side member 120 may be integrally formed.

The side member 120 may include the first side 122, the second side 124, the third side 126, and the fourth side 128. The second plate 110 may include the first non-conductive slot 130 disposed around the second side 124 and a second non-conductive slot 132 disposed around the fourth side 128. Both ends of the first non-conductive slot 130 may extend to the first point 124*a* and the second point 124*b* disposed on the second side 124. Both ends of the second non-conductive slot 132 may extend to a third point 128*a* and a fourth point 128*b* disposed on the fourth side 128. The vertical distances from each of the non-conductive slots 130 and 132 to the side surfaces 124 and 128 may be formed to be the same as or different from each other. The non-conductive slots 130 and 132 may include a non-conductive material (e.g., synthetic resin, resin, rubber, urethane, or the like) disposed on the second plate 110 that is made of metal by a double injection process or an insert molding process.

The circuit board 140 may be a printed circuit board (PCB) disposed within a space formed by the first plate, the second plate 110, and the side member 120. The circuit board 140 may include the at least one conductive pattern 150 or 155. The conductive pattern 150 or 155 may be included in the fill-cut area where the conductive ground area of the circuit board 140 is omitted. The conductive pattern 150 or 155 may be formed in a shape in which a substrate made of a dielectric material is omitted. When the conductive pattern 150 or 155 is assembled on or coupled to the housing 101, at least partial areas of the non-conductive slots 130 and 132 and the conductive patterns 150 and 155 disposed in the housing 101 may be disposed to overlap with each other in the vertical direction (e.g., Z-axis direction).

The display 104 may be exposed in at least a partial area of the first plate of the housing 101. The display 104 may include a window 104*a* and a display module 104*b* attached to the rear surface of the window 104*a*. The display 104 may operate as a touchscreen device including a touch sensor. The display 104 may operate as a resistive touchscreen device including a touch sensor and a pressure sensor, or other type of touchscreen device, e.g., capacitive, inductive, etc.

The support member 103 (e.g., an intermediate plate) may be interposed between the housing 101 and the display 104, and may support the circuit board 140 and a battery and reinforce the rigidity of the electronic device 100. The support member 103 may include a battery mounting part 103*b* and a substrate mounting part 103*c* disposed in a partial area at a periphery of the battery mounting part 103*b*. The circuit board 140 and the battery may be disposed side by side, i.e., in parallel with each other, without overlapping with the support member 103, and the at least partial area of the battery may be disposed in a manner in which the at least partial area of the battery overlaps with the support member 103 in a vertical direction (e.g., in the Z-axis direction). The intermediate plate 103 may include an opening 103*a* having a specific size formed in the battery mounting portion 103*b* so as to correspond to a swelling phenomenon of the battery.

Figure 2:
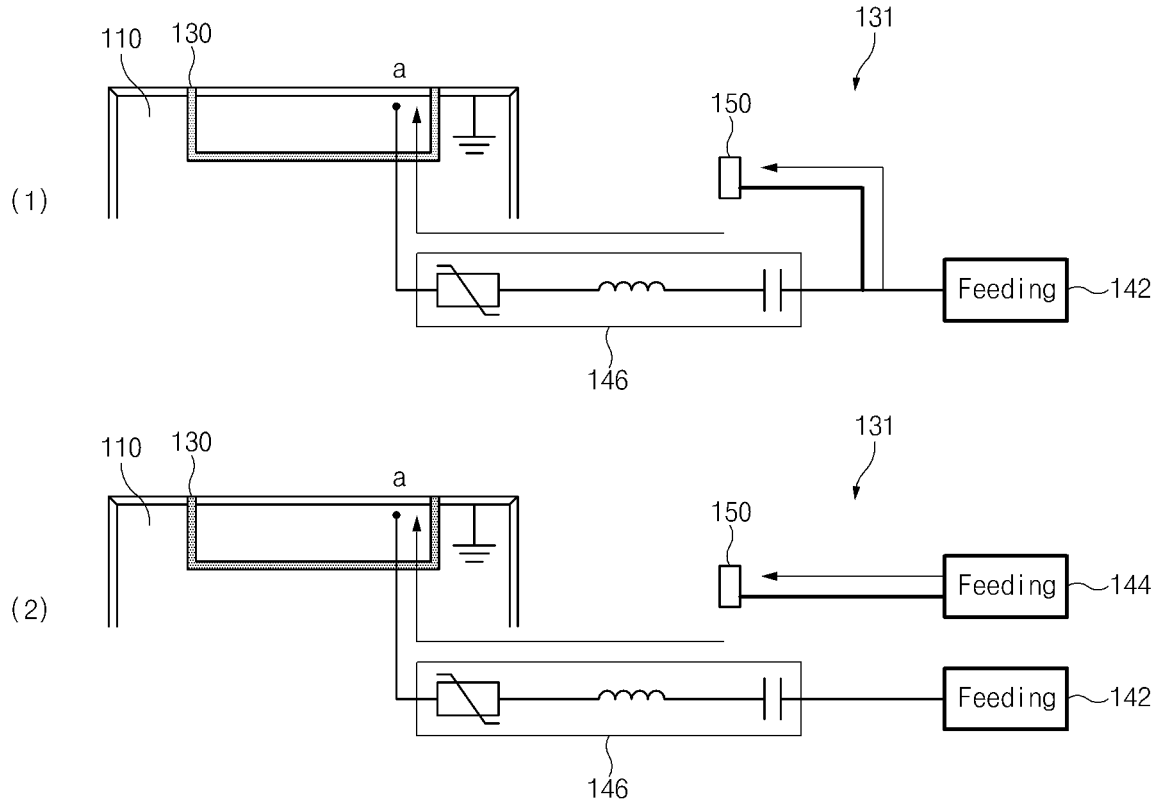
FIG. 2 is a diagram of a wireless communication circuit of an electronic device, according to an embodiment.

FIG. 2 is a diagram of a wireless communication circuit 131, according to an embodiment.

As noted above, the wireless communication circuit 131 is a component of the electronic device 100 and is configured to transmit and receive a signal of the first frequency band via an electrical path formed by the non-conductive slot 130. The wireless communication circuit 131 may be configured to transmit and receive a signal of a second frequency band different from the first frequency band, through the conductive pattern 150. The signal of the second frequency band may be received or may be transmitted through the non-conductive slot 130.

Referring to (1) of FIG. 2, the wireless communication circuit 131 may include the point 'a' of the second plate 110 adjacent to the non-conductive slot 130 and may include a feeding part 142 configured to feed the conductive pattern 150. The point 'a' of the second plate 110 may be experimentally determined through the non-conductive slot 130 for the purpose of transmitting and/or receiving a target frequency. The electronic device 100 may feed the point 'a' of the second plate 110 and the conductive pattern 150 by using one feeding part 142.

Referring to (1) of FIG. 2, the electronic device 100 may include the feeding part 142 electrically connected to the wireless communication circuit 131, the point 'a' of a conductive layer 110*b* of the second plate 110 adjacent to the non-conductive slot 130, and the conductive pattern 150. The wireless communication circuit 131 may be configured to feed the point 'a' of the conductive layer 110*a* and the conductive pattern 150 through the feeding part 142.

The wireless communication circuit 131 may further include a diplexer that divides signals received from the non-conductive slot 130 and the conductive pattern 150 into the signal (e.g., Wi-Fi signal of 2.4 GHz frequency) of the first frequency band and the signal (e.g., Wi-Fi signal of 5 GHz frequency) of the second frequency band.

Referring to (2) of FIG. 2, the wireless communication circuit 131 may include the first feeding part 142 configured to feed the point 'a' of a second plate adjacent to the non-conductive slot 130 and may include a second feeding part 144 configured to feed the conductive pattern 150. The loss of a signal by the diplexer may be reduced by dividing feeding parts into two separate components for respectively feeding the point 'a' of the second plate 110 and the conductive pattern 150.

Referring to (2) of FIG. 2, the electronic device 100 may further include the first feeding part 142 electrically connected to the wireless communication circuit 131, and the point 'a' of a conductive layer 110*b* of the second plate 110, and the electronic device 100 may further include a second feeding part 144 electrically connected to the wireless communication circuit 131 and the conductive pattern 150. The wireless communication circuit 131 may be configured to feed the point 'a' of the conductive layer 110*b* through the first feeding part 142 and may be configured to feed the conductive pattern 150 through the second feeding part 144.

Referring to (1) and (2) of FIG. 2, the electronic device 100 may include a matching circuit 146 positioned on an electrical path connecting the point 'a' of the second plate 110 to the wireless communication circuit 131. The wireless communication circuit 131 may be configured to support communication (e.g., GPS communication of 1.5 GHz frequency) of a third frequency band different from the first frequency band (e.g., Wi-Fi signal of 2.4 GHz frequency), by using the non-conductive slot 130. The wireless communication circuit 131 may transmit or receive two signals having different frequency bands through the non-conductive slot 130.

Figure 3A:
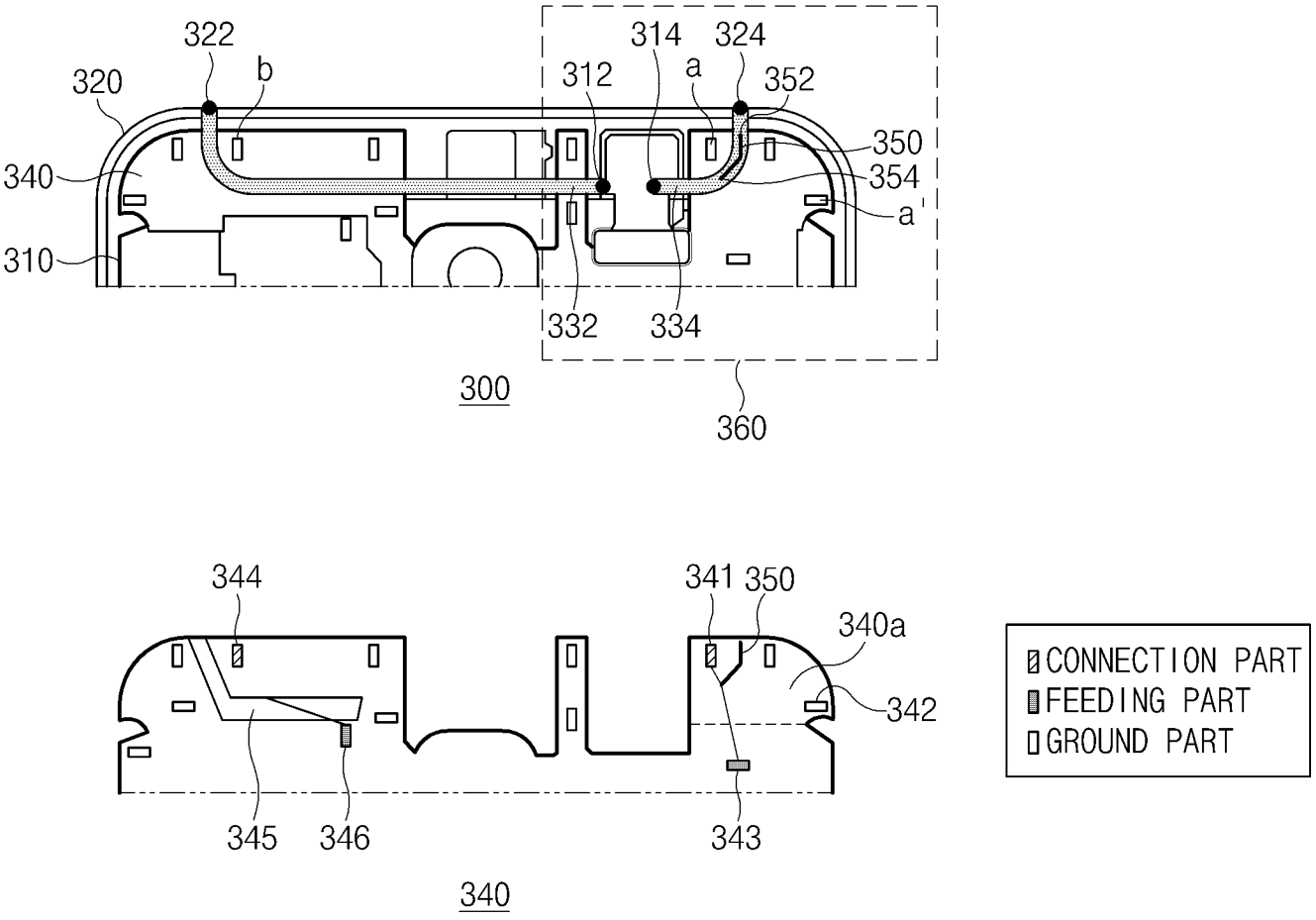
FIG. 3A is a diagram of a portion of an electronic device, according to embodiment.
Figure 3B:
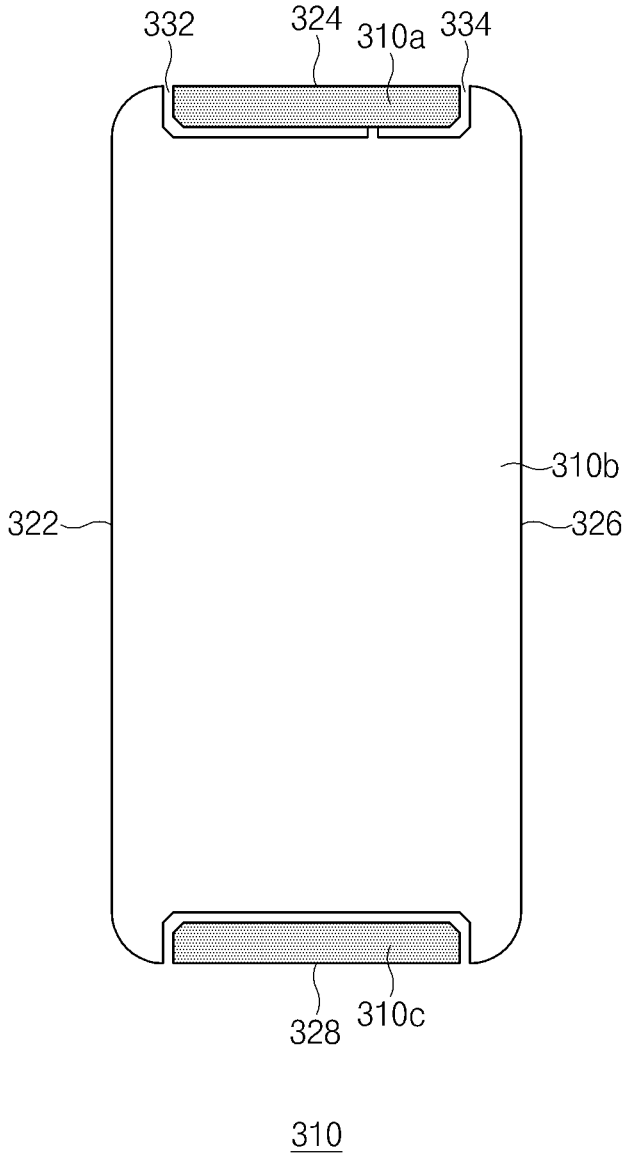
FIG. 3B is a diagram of a second plate, according to embodiment.

FIG. 3A is a diagram of an electronic device, according to an embodiment. FIG. 3B is a diagram of a second plate, according to an embodiment.

Referring to FIGS. 3A and 3B, an electronic device 300 may include a housing. The housing may include a first plate, a second plate 310 facing away from the first plate, and a side member 320 surrounding a space between the first plate and the second plate 310.

The second plate 310 of the electronic device 300 may include a first slot 332 and a second slot 334. The first slot 332 and the second slot 334 may be filled with a non-conductive material. The electronic device 300 may include a conductive material interposed between one end 312 of the first slot 332 and one end 314 of the second slot 334. The area other than the first slot 332 and the second slot 334 of the second plate 310 may be formed of a conductive material.

The electronic device 300 may include a circuit board 340 which is located inside the housing and in which a wireless communication circuit 331 (FIG. 4) is disposed. Referring to FIG. 3A, the circuit board 340 disposed inside the second plate 310 is separately illustrated under the second plate 110, and the circuit board 340 may be disposed inside the second plate 310.

The circuit board 340 may include the conductive pattern 350 formed on the circuit board 340 along the first slot 332 or the second slot 334 of the second plate 310. The conductive pattern 350 may be formed in the area of the circuit board 340 facing the first slot 332 or the second slot 334 so as to be the same as or similar to a portion of the shape of the first slot 332 or the second slot 334.

The first slot 332 and the second slot 334 may have various shapes. The conductive pattern 350 inside the housing may have a shape corresponding to the first slot 332 and/or the second slot 334.

The first slot 332 and the second slot 334 may have a U-shape. The first point of the first slot 332 and the second point of the second slot 334 may be formed to contact the edge of the second plate 310.

Referring to FIG. 3A, the conductive pattern 350 formed along the second slot 334 in a U-shape is illustrated. The conductive pattern 350 may be formed in a bent shape similar to a portion of the shape of the second slot 334.

The wireless communication circuit 331 of the electronic device 300 may be configured to feed a point 'b' of a second plate adjacent to the first slot 332 for receiving a signal of a first frequency band through an electrical path formed by the first slot 332 of the second plate 310. One portion of a first conductive layer 310*a*, one portion of a second conductive layer 310*b*, and one portion of the first slot 332 may be fed through the 'b' point, and thus may operate as a first antenna (e.g., long-term evolution (LTE) antenna).

The wireless communication circuit 331 of the electronic device 300 may be configured to feed a point 'a' of the second plate 310 adjacent to the second slot 334. The wireless communication circuit 331 may receive a signal of a second frequency band through an electrical path formed by the second slot 334. One portion of the first conductive layer 310*a*, one portion of the second conductive layer 310*b*, and one portion of the second slot 334 may be fed through the 'a' point, and thus may operate as a second antenna 360 (e.g., Wi-Fi antenna of 2.4 GHz).

The wireless communication circuit 331 of the electronic device 300 may be configured to feed the conductive pattern 350. The wireless communication circuit 331 may receive a signal of a third frequency band through the first slot 332 or the second slot 334. The conductive pattern 350 may operate as a third antenna (e.g., Wi-Fi antenna of 5 GHz) having the first conductive layer 310*a* used as the antenna radiator.

Since the second plate 310 is formed of a conductive material, a radiation space for the conductive pattern 350 positioned inside the electronic device 100 is required. The conductive pattern 350 may be disposed to face the first slot 332 or the second slot 334. The conductive pattern 350 may receive a signal through a partial area of the non-conductive material area filled in the first slot 332 or the second slot 334 and may transmit the signal.

The circuit board 340 of the electronic device 300 may be disposed inside the housing such that the conductive pattern 350 is formed to extend from a first point 352 of the second slot 334 to a second point 354 of the second slot 334 along the second slot 334, while facing the second slot 334.

The circuit board 340 may include a connection part 341 connected to the second plate 310 and a feeding part 343, and the circuit board 340 may include a ground part 342 that connects a ground layer of the circuit board 340 to the second plate 310.

The circuit board 340 may include a non-conductive area (e.g., a fill-cut area) 340*a*. The circuit board 140 may include the conductive pattern 350 formed in the non-conductive area 340*a*.

The circuit board 340 may include the feeding part 343 for feeding the 'a' point and the conductive pattern 350 and a feeding part 346 for feeding the 'b' point. The feeding parts 343 and 346 may be electrically connected to the processor of the circuit board 340. The circuit board 340 may include two feeding parts for feeding the 'a' point and the conductive pattern 350, respectively.

The circuit board 340 may include connection members 341 and 344 for directly/indirectly feeding the 'a' point of the second plate 310 and the 'b' point of the second plate 310. The connection members 341 and 344 may include a C-clip, a screw, a conductive member, or other suitable device.

The circuit board 340 may include a feeding line connected from the feeding part 343 to the connection member 341 and the conductive pattern 350. The feeding line may be disposed across a substrate slot 345 from the feeding part 346. Through feeding to the feeding point by the feeding line, the substrate slot 345 and the second plate 310 may operate as a slot antenna.

The circuit board 340 may include a ground layer connected to a ground point (e.g., a' point) of the second plate 310.

The substrate slot 345 corresponding to a portion of the first slot 332 may be formed on the circuit board 340, and the substrate slot 345 may operate as a slot antenna in conjunction with the first slot 332 of the second plate 310.

The side member 320 of the electronic device 100 may include at least a portion of the first slot 332 and at least a portion of the second slot 334. The first slot 332 and the second slot 334 may be formed in the partial area of the side member 320 and in the partial area of the second plate 310.

The circuit board 340 of the electronic device 300 may include another conductive pattern formed on the circuit board 340 along the third slot. The other conductive pattern may operate as another antenna, which uses the third conductive layer 110*c* as an antenna radiator.

The remaining area of the side member 320 other than one portion of the first slot 332, one portion of the second slot 334, and one portion of a third slot that are formed in the side member 320 may be formed of a conductive material. The electronic device 300 may include a five-sided metal housing in which the second plate 310 and the side member 320 are integrally formed or in which the second plate 310 and the side member 320 are formed to be removable.

The side member 320 may include the first side 322, the second side 324, the third side 325, and the fourth side 328. The first side 322 may extend in a first direction and may have a first length. The second side 324 may extend in a second direction perpendicular to the first direction and may have a second length shorter than the first length. The third side 326 may extend parallel to the first side 322 and may have the first length. The fourth side 328 may extend parallel to the second side 324 and may have the second length. The first slot 332 may extend from a first point of the second side 324 to a first point of the second plate (e.g., one end 312 of the first slot 332). The second slot 334 may extend from the second point of the second side 324 to one end of the second slot (e.g., one end 314 of the second slot 334) positioned at the second point of the second plate 310. For example, the first slot 332 and the second slot 334 may have a U-shape.

The circuit board 340 may include a conductive pattern formed along the first slot 332 of the second plate 310. The wireless communication circuit 331 may be configured to feed a conductive pattern formed along the first slot 332. The wireless communication circuit 331 may receive a signal of a fourth frequency band through the first slot 332 of the second plate 310.

The circuit board 340 may include a plurality of conductive patterns formed along the first slot 332, the second slot 334, and a third slot. Each of conductive patterns may operate as an antenna by using each slot as a radiation area.

Figure 4:
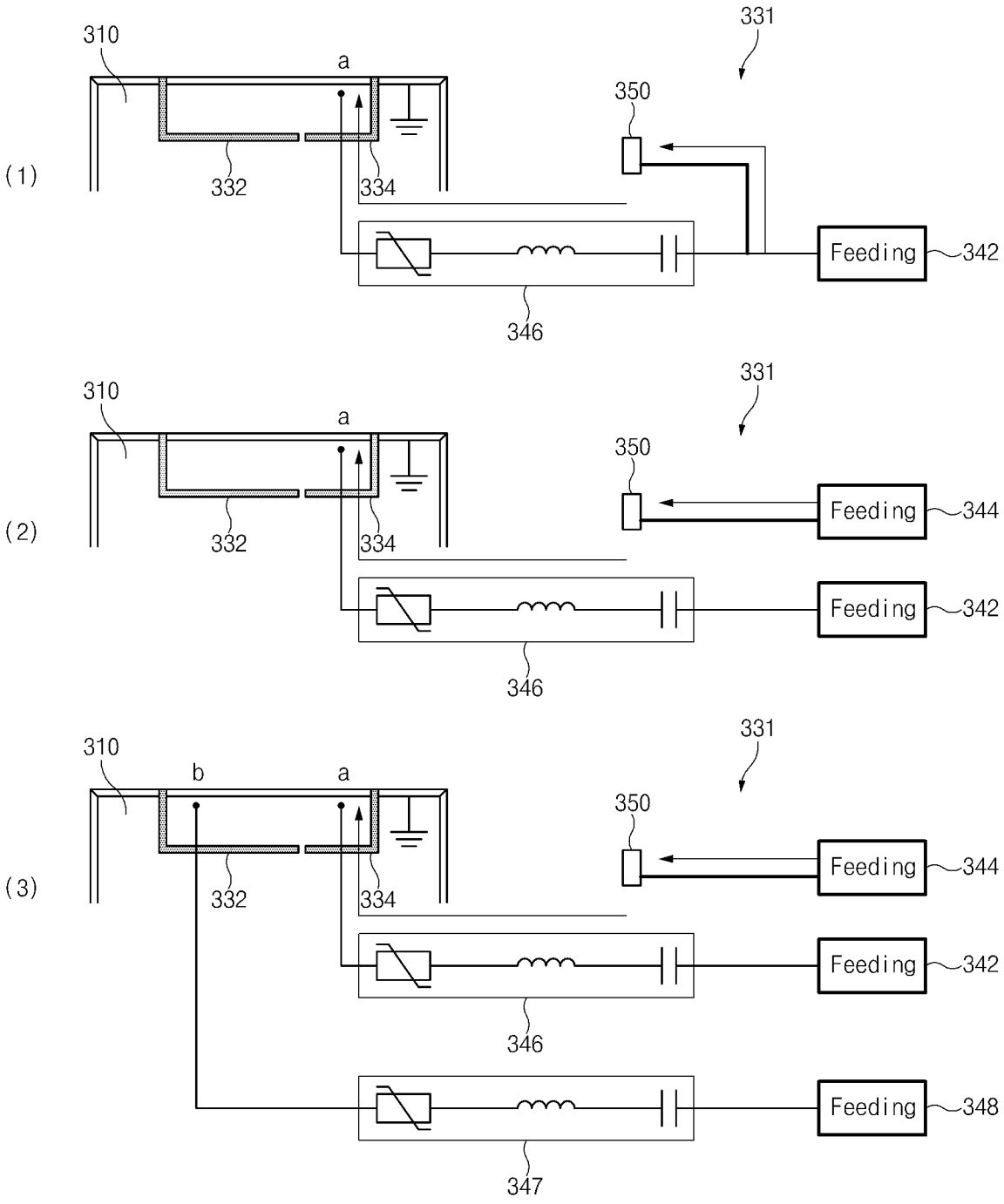
FIG. 4 is a diagram of a wireless communication circuit, according to embodiment.

FIG. 4 is a diagram of a wireless communication circuit 331, according to an embodiment.

Referring to (1) of FIG. 4, the electronic device 300 has one feeding part 342 for feeding one point of the second plate 310 adjacent to the second slot 334 and the conductive pattern 350.

Referring to (2) FIG. 4, the electronic device has a first feeding part 342 for feeding the point of the second plate 310 adjacent to the second slot 334 and a second feeding part 344 for feeding the conductive pattern 350. A description about a portion duplicated with FIG. 2 is omitted for clarity.

The electronic device 300 may include a matching circuit 346 positioned on an electrical path connecting the point 'a' of the second plate 310 adjacent to the second slot 334 to a wireless communication circuit 331. The wireless communication circuit 331 may be configured to support global positioning system (GPS) communication of 1.5 GHz frequency and Wi-Fi communication of 2.4 GHz frequency through the second slot 334.

The feeding part 342 may be configured to feed the point 'b' of the second plate 310 adjacent to the first slot 332. The electronic device 300 may receive a signal of a first frequency band through an electrical path formed by the first slot 332. Alternatively, the electronic device 300 may include a matching circuit 347 positioned on an electrical path connecting the point 'b' of the second plate 310 adjacent to the second slot 332 to a wireless communication circuit 331, and a third feeding part 348.

The electronic device 300 may transmit or receive a signal (e.g., LTE signal) of a frequency band between 700 MHz and 2700 MHz through the first slot 332 or may transmit or receive a GPS signal of 1.5 GHz frequency and a Wi-Fi signal of 2.4 GHz frequency band through the second slot 334. The electronic device 300 may transmit or receive a Wi-Fi signal of 5 GHz frequency band through the conductive pattern 350.

Figure 5:
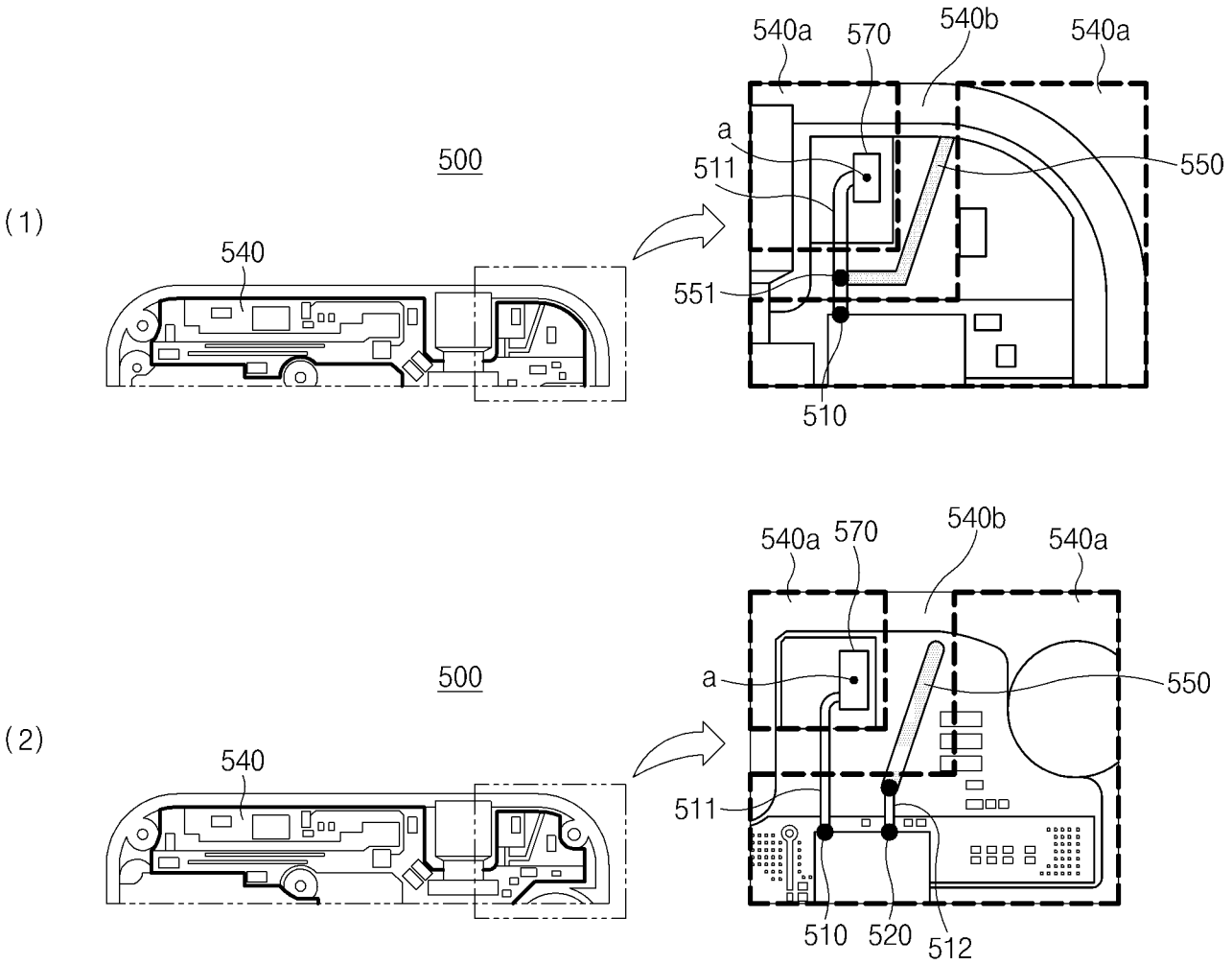
FIG. 5 is a diagram of an electronic device including one or two feeding parts, according to an embodiment.

FIG. 5 is a diagram of an electronic device including one or two feeding parts, according to an embodiment.

Referring to (1) of FIG. 5, an electronic device 500 may include one feeding part 510 for feeding a slot and a conductive pattern 550.

A circuit board 540 may include a feeding line 511 that is connected from a wireless communication circuit (e.g., the wireless communication circuit 131 and/or 331) to feeding a point 'a' of a second plate (e.g., the second plate 110 of FIG. 1A and/or the second plate 310 of FIG. 3A) and the conductive pattern 550. The circuit board 540 may include a connection point 551 at which the feeding line 511 meets the conductive pattern 550. The connection point 551 may be disposed at a location corresponding to the slot of the second plate on the circuit board 540.

Referring to (2) of FIG. 5, the electronic device 500 may include the first feeding part 510 for feeding a slot and a second feeding part 520 for feeding the conductive pattern 550. The circuit board 540 may include the first feeding line 511 connected from the first feeding part 510 of the wireless communication circuit to feeding the point 'a' of a second plate, and the circuit board 540 may include a second feeding line 512 connected from the second feeding part 520 of the wireless communication circuit to the conductive pattern 550.

The circuit board 540 may include a connection member physically/electrically connected from the point 'a' of the circuit board 540 to the second plate. For example, a connection member 570 can be provided and can be a C-clip, a screw, a conductive member, or the like.

A partial area 540*a* of the circuit board 540 may be disposed to face the conductive area of the second plate. Another area 540*b* of the circuit board 540 may be disposed to face the slot formed in the second plate.

Referring to (2) of FIG. 5, a portion of the conductive pattern 550 may be formed in the other area 540*b* overlapping with the slot formed in the second plate. The conductive pattern 550 of the circuit board 540 may be disposed inside a housing of the electronic device 500 to face the slot and to extend from a first point of the slot to a second point of the slot.

Figure 6A:
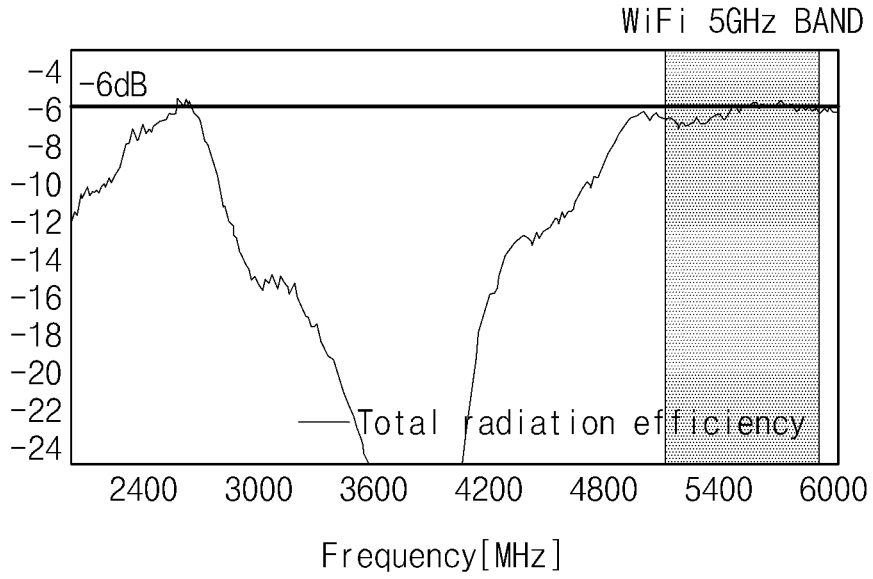
FIGS. 6A and 6B are graphs comparing efficiencies of antennas of an electronic device including one or two feeding parts, according to an embodiment.
Figure 6A:
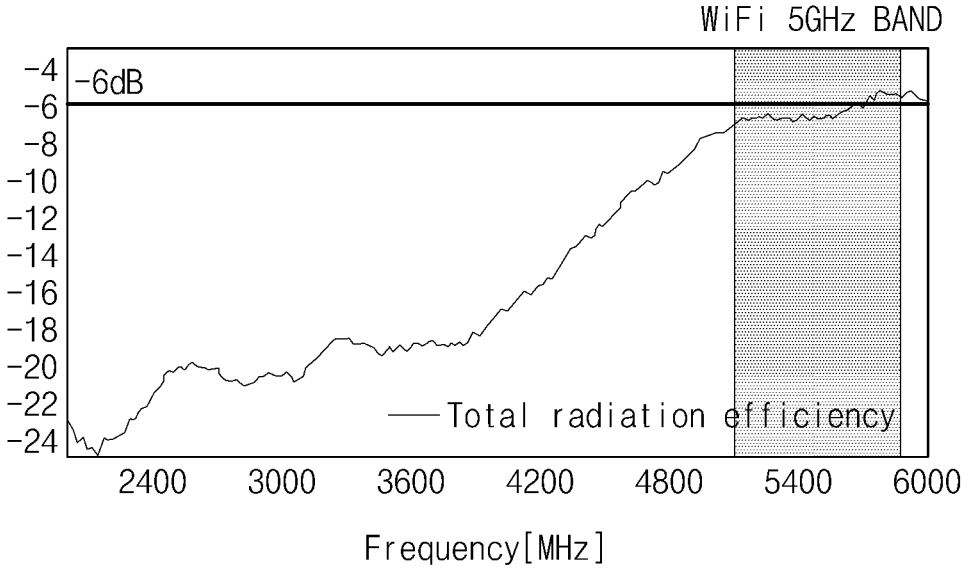
Figure 6B:
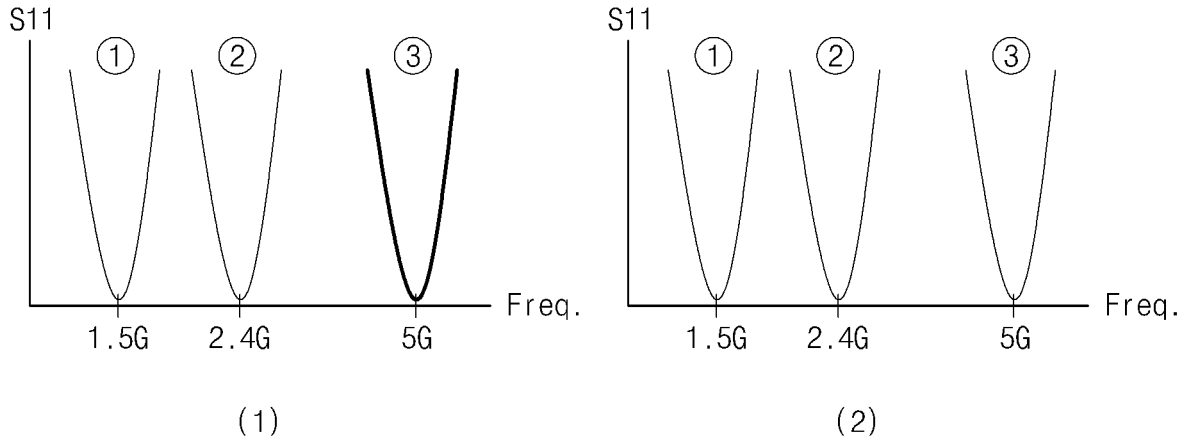

FIGS. 6A and 6B are graphs comparing efficiencies of antennas of an electronic device including one or two feeding parts, according to an embodiment.

Referring to FIG. 6A, with regard to an electronic device (e.g., the electronic device 100 of FIG. 1A) having a conductive pattern (e.g., the conductive pattern 150 of FIG. 1A), graph (1) illustrates the efficiency of a first antenna (e.g., Wi-Fi antenna of 1.4 GHz band) and a second antenna (e.g., Wi-Fi antenna of 5 GHz band) when there is one feeding part, and graph (2) illustrates the efficiency of the second antenna (e.g., Wi-Fi antenna of 5 GHz band) when there are two feeding parts.

Referring to graph (1) of FIG. 6A, the efficiency of a signal of about 2.4 GHz band of the first antenna and a signal of about 5 GHz band of the second antenna is relatively high. By using only one feeding part, a wireless communication circuit (e.g., the wireless communication circuit of FIG. 1A and the wireless communication circuit of FIG. 3A) may transmit or receive the signal of 2.4 GHz band of the first antenna and the signal of 5 GHz band of the second antenna, through a slot of the electronic device. For example, the wireless communication circuit may support Wi-Fi communication of a band between 2.4 GHz and 5 GHz.

Referring to graph (2) of FIG. 6A, the efficiency of a signal of about 5 GHz band of the second antenna is relatively high, and even a bit higher than the efficiency of graph (1). The wireless communication circuit may transmit or receive a signal of 5 GHz band of the second antenna, by using a conductive pattern. For example, the wireless communication circuit may support Wi-Fi communication of 5 GHz band.

Referring to graph (1) and graph (2) of FIG. 6A, the efficiency of the signal of 5 GHz band of the second antenna is relatively high in graph (1), compared with graph (2). When there two feeding parts used, the efficiency of the antenna may increase due to the signal loss by a diplexer being reduced.

Referring to FIG. 6B, a graph indicating a reflection loss of an antenna using a slot and a conductive pattern is illustrated. Graph (1) of FIG. 6B represents one feeding part being used, and graph (2) of FIG. 6B represents two feeding parts being used.

Referring to graph (1) and graph (2) of FIG. 6B, the antenna of an electronic device (e.g., the electronic device 100 of FIG. 1A or the electronic device 300 of FIG. 3A) resonates at about 1.5 GHz, 2.4 GHz, and 5 GHz.

The electronic device may support GPS communication of 1.5 GHz band and Wi-Fi communication of 2.4 GHz band by using the slot and may support Wi-Fi communication of 5 GHz band by using a conductive pattern of a circuit board.

When a slot and the feeding part of a circuit board are implemented both integrally and/or separately, the electronic device may support GPS communication and Wi-Fi communication.

Figure 7:
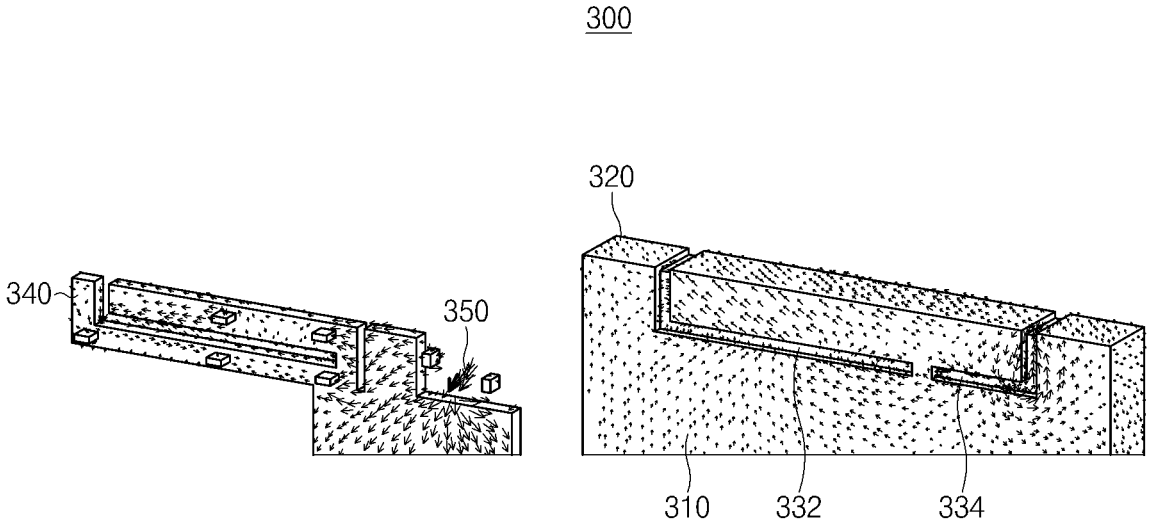
FIG. 7 is a diagram of a distribution of current when an electronic device performs wireless-fidelity (Wi-Fi) communication of 5 GHz band, according to an embodiment.

FIG. 7 is a diagram of a distribution of current when an electronic device performs communication through a conductive pattern, according to an embodiment. The conductive pattern 350 may support Wi-Fi communication of 5

GHz band. The intensity of the current is proportional to the number of arrows and the length of an arrow.

Referring to FIG. 7, the current is concentrated in an area where the conductive pattern 350 is located, and in the circuit board 340 of the electronic device 300. The current is concentrated in the slot 334 formed in the second plate 310 and the side member 320 of the electronic device 300.

A Wi-Fi signal of 5 GHz that is transmitted and/or received through the conductive pattern 350 disposed inside the electronic device 300 may be transmitted from electronic device 300 through the slot area of the electronic device 300 or may be received at the electronic device 300.

An electronic device may include a housing including a first plate, a second plate facing away from the first plate, and a side member surrounding a space between the first plate and the second plate, a touchscreen display exposed through at least a portion of the first plate, a conductive pattern positioned between the first plate and the second plate, and a wireless communication circuit positioned inside the space, and electrically connected to the conductive pattern. The communication circuit may be configured to support WI-FI communication in a frequency range between 2.4 GHz and 5 GHz. The side member may be integrally formed with or attached to the second plate. The second plate may include a conductive layer and a non-conductive slot formed through the conductive layer. The non-conductive slot may extend from a first portion of the side member to a second portion of the side member, such that the non-conductive slot and the side member together form a closed loop when viewed from above the second plate, and the conductive pattern may include an elongated portion overlapping at least partly with the non-conductive slot when viewed from above the second plate.

The wireless communication circuit may be configured to provide a signal with a frequency of 5 GHz to a portion of the conductive pattern.

The non-conductive slot may include a first portion extending in a first direction, a second portion extending in a second direction substantially perpendicular to the first direction, and a third portion extending in the first direction. A first end of the second portion of the non-conductive slot may be connected to the first portion of the non-conductive slot and a second end of the second portion of the non-conductive slot may be connected to the third portion of the non-conductive slot.

The non-conductive slot may form a U shape when viewed from above the second plate.

The elongated portion may overlap at least partly with the first or third portion of the non-conductive slot.

The electronic device may further include a feeding part electrically connected to the wireless communication circuit, a first point of the conductive layer adjacent to the non-conductive slot, and the conductive pattern. The wireless communication circuit is configured to feed the first point of the conductive layer and the conductive pattern through the feeding part.

The wireless communication circuit may further include a diplexer dividing signals received through the non-conductive slot and the conductive pattern into a signal of 2.4 GHz frequency and a signal of 5 GHz frequency.

The electronic device may further include a first feeding part electrically connected to the wireless communication circuit, and a first point of the conductive layer adjacent to the non-conductive slot and a second feeding part electrically connected to the wireless communication circuit and the conductive pattern. The wireless communication circuit may be configured to feed the first point of the conductive layer through the first feeding part and to feed the conductive pattern through the second feeding part.

The wireless communication circuit may be configured to support Wi-Fi communication of 2.4 GHz frequency by using the non-conductive slot and to support Wi-Fi communication of 5 GHz frequency by using the conductive pattern. The signal of 5 GHz frequency may be transmitted to the outside of the electronic device or may be received to the electronic device, through the non-conductive slot.

The electronic device may further include a matching circuit positioned on an electrical path connecting a first point of the conductive layer adjacent to the non-conductive slot to the wireless communication circuit. The wireless communication circuit may be configured to support Wi-Fi communication of 2.4 GHz frequency and GPS communication of 1.5 GHz frequency by using the non-conductive slot.

An electronic device may include a housing including a first plate, a second plate facing the first plate, and a side member surrounding a space between the first plate and the second plate and a circuit board, which is accommodated inside a housing and in which a wireless communication circuit is disposed. The second plate may include a slot filled with a non-conductive material. An area other than the slot may be formed of a conductive material. The circuit board may include a conductive pattern formed on the circuit board along the slot of the second plate, and the wireless communication circuit may be configured to feed one point of the second plate adjacent to the slot to receive a signal of a first frequency band through an electrical path formed by the slot and to feed the conductive pattern to receive a signal of a second frequency band through the slot.

The wireless communication circuit may include a feeding part feeding the one point of the second plate adjacent to the slot and the conductive pattern and a diplexer dividing signals received from the slot and the conductive pattern into the signal of the first frequency band and the signal of the second frequency band.

The wireless communication circuit may be configured to a first feeding part feeding the one point of the second plate adjacent to the slot and a second feeding part feeding the conductive pattern.

The side member may include at least part of the slot, and an area of the side member other than the at least part of the slot may be formed of a conductive material.

The side member may include a first side extending in a first direction and having a first length, a second side extending in a second direction perpendicular to the first direction and having a second length shorter than the first length, a third side extending in parallel to the first side and having the first length, and a fourth side extending in parallel to the second side and having the second length, and the slot may be formed to extending from a first point of the second side to a second point of the second side along the second plate.

The circuit board may be disposed inside the housing such that the conductive pattern is formed to extend from a first point of the slot to a second point of the slot along the slot while facing the slot.

An electronic device may include a housing including a first plate, a second plate facing the first plate, and a side member surrounding a space between the first plate and the second plate; and a circuit board, which is accommodated inside a housing and in which a wireless communication circuit is disposed. The second plate may include a first slot and a second slot, which are filled with a non-conductive material and includes a conductive material interposed between one end of the first slot and one end of the second slot. An area other than the first slot and second slot of the second plate may be formed of a conductive material. The circuit board may include a conductive pattern formed on the circuit board along the second slot of the second plate, and the wireless communication circuit may be configured to feed one point of the second plate adjacent to the first slot to receive a signal of a first frequency band through an electrical path formed by the first slot of the second plate, to feed another point of the second plate adjacent to the second slot to receive a signal of a second frequency band through an electrical path formed by a second slot of the second plate, and to feed the conductive pattern to receive a signal of a third frequency band through the second slot.

The side member may include a first side extending in a first direction and having a first length, a second side extending in a second direction perpendicular to the first direction and having a second length shorter than the first length, a third side surface extending in parallel to the first side surface and having the first length, and a fourth side surface extending in parallel to the second side surface and having the second length. The first slot may be formed to extend from a first point of the second side surface to a first point of the second plate, and the second slot may be formed to extend from a second point of the second side surface to the one end of the second slot positioned at a second point of the second plate.

The circuit board may include the conductive pattern formed along the first slot of the second plate, and the wireless communication circuit may be configured to feed the conductive pattern formed along the first slot, to receive a signal of a fourth frequency band through the first slot of the second plate.

Figure 8:
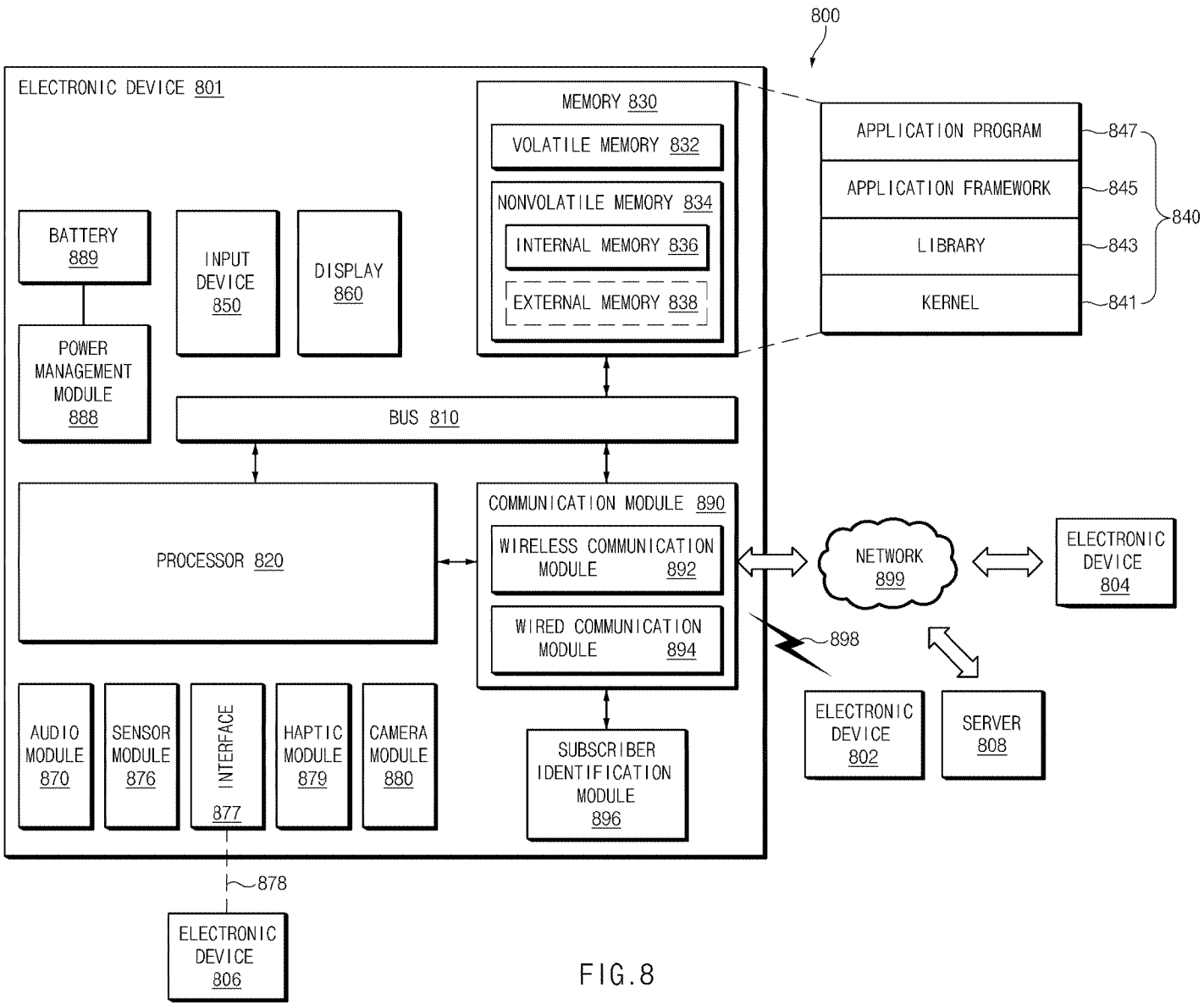
FIG. 8 is a diagram of an electronic device in a network environment, according to an embodiment.

The wireless communication circuit may be configured to feed the one point of the second plate adjacent to the second slot to receive a GPS signal of 1.5 GHz band and a Wi-Fi signal of 2.4 GHz band through the electrical path formed in the second slot and to feed the conductive pattern to receive a Wi-Fi signal of 5 GHz band through the second slot. FIG. 8 illustrates an electronic device 801 in a network environment 800, according to an embodiment. The electronic device 801 may be included in one or more types of the devices described above.

Referring to FIG. 8, under the network environment 800, the electronic device 801 (which can include all or some of the components described above with respect to the electronic device 100 of FIG. 1 and/or the electronic device 300 of FIG. 3A) may communicate with an electronic device 802 through local wireless communication interface 898 or may communication with an electronic device 804 or a server 808 through a network 899. The electronic device 801 may communicate with the electronic device 804 through a server 808.

The electronic device 801 may include a bus 810, a processor 820, a memory 830, an input device 850 (e.g., a micro-phone or a mouse), a display device 860, an audio module 870, a sensor module 876, an interface 877, a haptic module 879, a camera module 880, a power management module 888, a battery 889, a communication module 890, and a subscriber identification module (SIM) 896. The electronic device 801 may not include at least one (e.g., the display device 860 or the camera module 880) of the above-described elements or may further include other element(s).

The bus 810 may interconnect the above-described elements 820 to 890 and may include a circuit for conveying signals (e.g., a control message or data) between the above-described elements.

The processor 820 may include one or more of a central processing unit (CPU), an application processor (AP), a graphic processing unit (GPU), an image signal processor (ISP) of a camera or a communication processor (CP). The processor 820 may be implemented with a system on chip (SoC) or a system in package (SiP). The processor 820 may drive an operating system (OS) or an application to control at least one of another element (e.g., hardware or software element) connected to the processor 820 and may process and compute various data. The processor 820 may load a command or data, which is received from at least one of other elements (e.g., the communication module 890), into a volatile memory 832 to process the command or data and may store the result data into a nonvolatile memory 834.

The memory 830 may include the volatile memory 832 or the nonvolatile memory 834. The volatile memory 832 may include a random access memory (RAM) (e.g., a dynamic RAM (DRAM), a static RAM (SRAM), or a synchronous DRAM (SDRAM)). The nonvolatile memory 834 may include a programmable read-only memory (PROM), an one time PROM (OTPROM), an erasable PROM (EPROM), an electrically EPROM (EEPROM), a mask ROM, a flash ROM, a flash memory, a hard disk drive (HDD), or a solid-state drive (SSD). In addition, the nonvolatile memory 834 may be configured in the form of an internal memory 836 or the form of an external memory 838 which is available through connection only if necessary, according to the connection with the electronic device 801. The external memory 838 may further include a flash drive such as compact flash (CF), secure digital (SD), micro secure digital (Micro-SD), mini secure digital (Mini-SD), extreme digital (xD), a multimedia card (MMC), or a memory stick. The external memory 838 may be operatively or physically connected with the electronic device 801 in a wired manner (e.g., a cable or a universal serial bus (USB)) or a wireless (e.g., Bluetooth (BT)) manner.

The memory 830 may store at least one different software element, such as a command or data associated with the program 840, of the electronic device 801. The program 840 may include a kernel 841, a library 843, an application framework 845 or an application program (application) 847.

The input device 850 may include a microphone, a mouse, or a keyboard. The keyboard may include a keyboard physically connected to the electronic device 801 or a virtual keyboard displayed through the display 860.

The display 860 may include a display, a hologram device or a projector, and a control circuit to control a relevant device. The display may include a liquid crystal display (LCD), a light emitting diode (LED) display, an organic LED (OLED) display, a microelectromechanical systems (MEMS) display, or an electronic paper display. The display may be flexible, transparent, or wearable. The display may include a touch circuitry, which is able to detect a user's input such as a gesture input, a proximity input, or a hovering input or a pressure sensor (a force sensor) which is able to measure the intensity of the pressure by the touch. The touch circuit or the pressure sensor may be implemented integrally with the display or may be implemented with at least one sensor separately from the display. The hologram device may show a stereoscopic image in a space using interference of light. The projector may project light onto a screen to display an image. The screen may be located inside or outside the electronic device 801.

The audio module 870 may convert from a sound into an electrical signal or from an electrical signal into the sound. The audio module 870 may acquire sound through the input device 850 (e.g., a microphone) or may output sound through an output device (e.g., a speaker or a receiver) included in the electronic device 801, the electronic device 802 (e.g., a wireless speaker or a wireless headphone) or the electronic device 806 (e.g., a wired speaker or a wired headphone) connected with the electronic device 801.

The sensor module 876 may measure or detect an internal operating state (e.g., power or temperature) of the electronic device 801 or an external environment state (e.g., an altitude, a humidity, or brightness) to generate an electrical signal or a data value corresponding to the information of the measured state or the detected state. The sensor module 876 may include at least one of a gesture sensor, a gyro sensor, a barometric pressure sensor, a magnetic sensor, an acceleration sensor, a grip sensor, a proximity sensor, a color sensor (e.g., a red, green, blue (RGB) sensor), an infrared sensor, a biometric sensor (e.g., an iris sensor, a fingerprint sensor, a heartbeat rate monitoring (HRM) sensor, an e-nose sensor, an electromyography (EMG) sensor, an electroencephalogram (EEG) sensor, an electrocardiogram (ECG) sensor), a temperature sensor, a humidity sensor, an illuminance sensor, or an ultra violet (UV) sensor. The sensor module 876 may further include a control circuit for controlling at least one or more sensors included therein. The sensor module 876 may be controlled by using the processor 820 or a processor (e.g., a sensor hub) separate from the processor 820. When the separate processor (e.g., a sensor hub) is used, while the processor 820 is in a sleep state, the separate processor may operate without awakening the processor 820 to control at least a portion of the operation or the state of the sensor module 876.

The interface 877 may include a high definition multimedia interface (HDMI), a USB, an optical interface, a recommended standard 232 (RS-232), a D-subminiature (D-sub), a mobile high-definition link (MHL) interface, a SD card/MMC (multi-media card) interface, or an audio interface. A connector 878 may physically connect the electronic device 801 and the electronic device 806. The connector 878 may include a USB connector, an SD card/MMC connector, or an audio connector (e.g., a headphone connector).

The haptic module 879 may convert an electrical signal into mechanical stimulation (e.g., vibration or motion) or into electrical stimulation. The haptic module 879 may apply tactile or kinesthetic stimulation to a user. The haptic module 879 may include, for example, a motor, a piezoelectric element, or an electric stimulator.

The camera module 880 may capture a still image and a moving picture. The camera module 880 may include at least one lens (e.g., a wide-angle lens and a telephoto lens, or a front lens and a rear lens), an image sensor, an image signal processor, or a flash (e.g., a light emitting diode or a xenon lamp).

The power management module 888, which is to manage the power of the electronic device 801, may constitute at least a portion of a power management integrated circuit (PMIC).

The battery 889 may include a primary cell, a secondary cell, or other type of cell and may be recharged by an external power source to supply power to least one element of the electronic device 801.

The communication module 890 may establish a communication channel between the electronic device 801 and the first external electronic device 802, the second external electronic device 804, or the server 808. The communication module 890 may support wired communication or wireless communication through the established communication channel. The communication module 890 may include a wireless communication module 892 or a wired communication module 894. The communication module 890 may communicate with the external device through a first network 898 (e.g. a wireless local area network such as BT or Infrared Data Association (IrDA)) or a second network 899 (e.g., a wireless wide area network such as a cellular network) through a relevant module among the wireless communication module 892 or the wired communication module 894.

The wireless communication module 892 may support cellular communication, local wireless communication, global navigation satellite system (GNSS) communication. The cellular communication may include LTE, LTE Advance (LTE-A), code division multiple access (CMA), wideband CDMA (WCDMA), universal mobile telecommunications system (UMTS), wireless broadband (WiBro), or global system for mobile communications (GSM). The local wireless communication may include Wi-Fi, Wi-Fi direct, light fidelity (Li-Fi), BT, BT low energy (BLE), Zigbee, near field communication (NFC), magnetic secure transmission (MST), radio frequency (RF), or a body area network (BAN). The GNSS may include at least one of a GPS, a global navigation satellite system (Glonass), Beidou Navigation Satellite System (Beidou), the European global satellite-based navigation system (Galileo), or the like. In the disclosure, GPS and GNSS may be interchangeably used.

When the wireless communication module 892 supports cellar communication, the wireless communication module 892 may identify or authenticate the electronic device 801 within a communication network using the SIM 896. The wireless communication module 892 may include a CP separate from the processor 820 (e.g., an AP). The communication processor may perform at least a portion of functions associated with at least one of elements 810 to 896 of the electronic device 801 in substitute for the processor 820 when the processor 820 is in an inactive (sleep) state, and together with the processor 820 when the processor 820 is in an active state. The wireless communication module 892 may include a plurality of communication modules, each supporting only a relevant communication scheme among cellular communication, local wireless communication, or a GNSS communication.

The wired communication module 894 may include a local area network (LAN) service, a power line communication, or a plain old telephone service (POTS).

The first network 898 may employ Wi-Fi direct or BT for transmitting or receiving commands or data through wireless direct connection between the electronic device 801 and the first external electronic device 802. The second network 899 may include a telecommunication network (e.g., a computer network such as a LAN or a WAN, the Internet or a telephone network) for transmitting or receiving commands or data between the electronic device 801 and the second electronic device 804.

The commands or the data may be transmitted or received between the electronic device 801 and the second external electronic device 804 through the server 808 connected with the second network 899. Each of the first and second external electronic devices 802 and 804 may be a device of which the type is different from or the same as that of the electronic device 801. All or a part of operations that the electronic device 801 will perform may be executed by the electronic devices 802 and 804 or the server 808. When the electronic device 801 executes any function or service automatically or in response to a request, the electronic device 801 may not perform the function or the service internally, but may alternatively or additionally transmit requests for at least a part of a function associated with the electronic device 801 to the electronic device 802 or 804 or the server 808. The electronic device 802 or 804 or the server 808 may execute the requested function or additional function and may transmit the execution result to the electronic device 801. The electronic device 801 may provide the requested function or service using the received result or may additionally process the received result to provide the requested function or service. To this end, for example, cloud computing, distributed computing, or client-server computing may be used.

At least a part of an apparatus (e.g., modules or functions thereof) or a method (e.g., operations) may be implemented by instructions stored in a non-transitory computer-readable storage media (e.g., the memory 830) in the form of a program module. The instruction, when executed by a processor (e.g., a processor 820), may cause the processor to perform a function corresponding to the instruction. The non-transitory computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), an embedded memory, and the like. The one or more instructions may contain a code made by a compiler or a code executable by an interpreter.

Each element (e.g., a module or a program module) may be composed of single entity or a plurality of entities, a part of the above-described sub-elements may be omitted or may further include other sub-elements. Alternatively or additionally, after being integrated in one entity, some elements (e.g., a module or a program module) may identically or similarly perform the function executed by each corresponding element before integration. Operations executed by modules, program modules, or other elements may be executed by a successive method, a parallel method, a repeated method, or a heuristic method, or at least one part of operations may be executed in different sequences or omitted. Alternatively, other operations may be added.

While the disclosure has been shown and described with reference to certain embodiments thereof, it will be understood by those skilled in the art that various changes in form and details may be made therein without departing from the scope of the disclosure. Therefore, the scope of the disclosure should not be defined as being limited to the embodiments, but should be defined by the appended claims and equivalents thereof.

What is claimed is:

1. An electronic device comprising:

a housing including a first plate, a second plate facing away from the first plate, and a side member surrounding a space between the first plate and the second plate;

a conductive pattern positioned between the first plate and the second plate; and a wireless communication circuit positioned inside the space, and electrically connected to the conductive pattern, wherein the side member is integrally formed with or attached to the second plate, wherein the second plate includes a conductive layer and a non-conductive slot formed through the conductive layer, wherein the non-conductive slot extends from a first portion of the side member to a second portion of the side member, such that the non-conductive slot and the side member form a closed loop, and the non-conductive slot includes a third portion extending in a first direction, wherein the first portion extends in the first direction and the second portion extends in a second direction substantially perpendicular to the first direction, wherein the conductive pattern includes an elongated portion that at least partially overlaps the non-conductive slot and wherein the elongated portion at least partially overlaps one of the first portion and the third portion of the non-conductive slot.

2. The electronic device of claim 1, wherein the wireless communication circuit is configured to provide a signal with a frequency of 5 GHz to a portion of the conductive pattern.

3. The electronic device of claim 1, wherein a first end of the second portion of the non-conductive slot is connected to the first portion of the non-conductive slot and a second end of the second portion of the non-conductive slot is connected to the third portion of the non-conductive slot.

4. The electronic device of claim 1, wherein the non-conductive slot forms a U shape.

5. The electronic device of claim 1, further comprising:

a feeding part electrically connected to the wireless communication circuit, a first point of the conductive layer adjacent to the non-conductive slot, and the conductive pattern, wherein the wireless communication circuit is configured to feed the first point of the conductive layer and the conductive pattern through the feeding part.

6. The electronic device of claim 1, wherein the wireless communication circuit is configured to support wireless-fidelity (Wi-Fi) communication in a frequency range between 2.4 GHz and 5 GHz, and wherein the wireless communication circuit includes:

a diplexer configured to divide signals received through the non-conductive slot and the conductive pattern into a signal of 2.4 GHz frequency and a signal of 5 GHz frequency.

7. The electronic device of claim 1, further comprising:

a first feeding part electrically connected to the wireless communication circuit, and a first point of the conductive layer adjacent to the non-conductive slot; and a second feeding part electrically connected to the wireless communication circuit and the conductive pattern, wherein the wireless communication circuit is configured to:

feed the first point of the conductive layer through the first feeding part; and feed the conductive pattern through the second feeding part.

8. The electronic device of claim 1, wherein the wireless communication circuit is configured to:

support Wi-Fi communication of 2.4 GHz frequency using the non-conductive slot; and support Wi-Fi communication of 5 GHz frequency using the conductive pattern, and wherein a signal of the 5 GHz frequency is one of transmitted from the electronic device and received at the electronic device, through the non-conductive slot.

9. The electronic device of claim 1, further comprising:

a matching circuit positioned on an electrical path connecting a first point of the conductive layer adjacent to the non-conductive slot to the wireless communication circuit, wherein the wireless communication circuit is configured to support Wi-Fi communication of 2.4 GHz frequency and GPS communication of 1.5 GHz frequency using the non-conductive slot.

10. An electronic device comprising:

a housing including a first plate, a second plate facing the first plate, and a side member surrounding a space between the first plate and the second plate; and a circuit board including a wireless communication circuit, wherein the second plate includes a slot filled with a non-conductive material, wherein an area other than the slot is formed of a conductive material, wherein the circuit board includes a conductive pattern and the slot of the second plate, and wherein the wireless communication circuit is configured to:

feed one point adjacent to the slot to receive a signal of a first frequency band through an electrical path formed by the slot; and feed the conductive pattern to receive a signal of a second frequency band through the slot.

11. The electronic device of claim 10, wherein the wireless communication circuit includes:

a feeding part configured to feed the one point adjacent to the slot and the conductive pattern; and a diplexer configured to divide signals received through the slot and the conductive pattern into the signal of the first frequency band and the signal of the second frequency band.

12. The electronic device of claim 10, wherein the wireless communication circuit includes:

a first feeding part configured to feed the one point adjacent to the slot; and a second feeding part configured to feed the conductive pattern.

13. The electronic device of claim 10, wherein the side member includes at least part of the slot, and wherein an area of the side member other than the at least part of the slot is formed of a conductive material.

14. The electronic device of claim 10, wherein the side member includes a first side surface extending in a first direction and having a first length, a second side surface extending in a second direction perpendicular to the first direction and having a second length shorter than the first length, a third side surface extending in parallel to the first side surface and having the first length, and a fourth side surface extending in parallel to the second side surface and having the second length, and wherein the slot extends from a first point of the second side surface to a second point of the second side surface along the second plate.

15. The electronic device of claim 10, wherein the circuit board is disposed inside the housing such that the conductive pattern is formed to extend from a first point of the slot to a second point of the slot along the slot while facing the slot.

16. An electronic device comprising:

a housing including a first plate, a second plate facing the first plate, and a side member surrounding a space between the first plate and the second plate; and a circuit board including a wireless communication circuit, wherein the second plate includes a first slot and a second slot, which are filled with a non-conductive material and includes a conductive material interposed between one end of the first slot and one end of the second slot, wherein an area other than the first slot and second slot of the second plate is formed of a conductive material, wherein the circuit board includes a first conductive pattern formed on the circuit board along the second slot of the second plate, and wherein the wireless communication circuit is configured to:

feed one point of the second plate adjacent to the first slot to receive a signal of a first frequency band through an electrical path formed by the first slot of the second plate;

feed another point of the second plate adjacent to the second slot to receive a signal of a second frequency band through an electrical path formed by a second slot of the second plate; and feed the first conductive pattern to receive a signal of a third frequency band through the second slot.

17. The electronic device of claim 16, wherein the side member includes a first side extending in a first direction and having a first length, a second side extending in a second direction perpendicular to the first direction and having a second length shorter than the first length, a third side extending in parallel to the first side and having the first length, and a fourth side extending in parallel to the second side and having the second length, wherein the first slot extends from a first point of the second side to a first point of the second plate, and wherein the second slot extends from a second point of the second side to the one end of the second slot positioned at a second point of the second plate.

18. The electronic device of claim 16, wherein the circuit board includes a second conductive pattern formed along the first slot of the second plate, and wherein the wireless communication circuit is configured to:

feed the second conductive pattern formed along the first slot, to receive a signal of a fourth frequency band through the first slot of the second plate.

19. The electronic device of claim 16, wherein the wireless communication circuit is configured to:

feed the one point of the second plate adjacent to the second slot to receive a GPS signal of 1.5 GHz band and a Wi-Fi signal of 2.4 GHz band through the electrical path formed in the second slot; and feed the first conductive pattern to receive a Wi-Fi signal of 5 GHz band through the second slot.

* * * * *